US005579538A

United States Patent [19]

Brunty

[11] Patent Number: 5,579,538

[45] Date of Patent: Dec. 3, 1996

[54] SHOULDER PAD ACCESSORY

[76] Inventor: Steven H. Brunty, 60 Township Rd. 1118 Apt. 3, Chesapeake, Ohio 45019

[21] Appl. No.: 345,786

[22] Filed: Nov. 22, 1994

[51] Int. Cl.[6] ..... A41D 13/00

[52] U.S. Cl. ..... 2/2

[58] Field of Search ..... 2/2, 267, 53, 54, 2/268, 908, 44, 45

[56] References Cited

U.S. PATENT DOCUMENTS

| | | | |
|---|---|---|---|
| 579,825 | 3/1897 | Harrison . | |
| 2,108,336 | 2/1938 | Helland | 2/2 |
| 2,320,705 | 6/1943 | Reynolds . | |
| 2,369,229 | 2/1945 | Hamlin . | |
| 2,808,589 | 10/1957 | Tyroler . | |
| 3,189,917 | 6/1965 | Sims | 2/2 |
| 3,739,397 | 6/1973 | Truelove | 2/2 |
| 4,514,862 | 5/1985 | A'Costa . | |
| 4,573,216 | 3/1986 | Wortberg . | |
| 4,590,622 | 5/1986 | Wolfe et al. | 2/2 |
| 4,654,893 | 4/1987 | Meyers et al. . | |
| 4,679,253 | 7/1987 | Mitchell et al. | 2/2 |
| 4,985,931 | 1/1991 | Wingo, Jr. . | |
| 5,060,313 | 10/1991 | Neuhalfen . | |
| 5,063,941 | 11/1991 | White . | |
| 5,107,542 | 4/1992 | Zide et al. . | |
| 5,129,101 | 7/1992 | Douglas . | |
| 5,337,417 | 8/1994 | Whiteside et al. | 2/2 |

*Primary Examiner*—Paul C. Lewis
*Attorney, Agent, or Firm*—Richard C. Litman

[57] ABSTRACT

A shoulder pad having a pair of impact absorbing accessory pads disposed adjacent the armpits of a user. The shoulder pad includes a left body arch member and a right body arch member. A left chest portion and a left back portion depend from the left arch member. Two left strap members extends from the left back portion to the left chest portion. A right chest portion and a right back portion depend from the right arch member. Two right strap members extend from the right back portion to the right chest portion. The left and right straps secure the shoulder pad to the body of the user. A left accessory pad and a right accessory pad are attached to the left and right strap members. The accessory pads are disposed adjacent the armpits of the user and between the users arms and ribs. Each pad includes a wedge shaped cushion having a concave side and a opposing convex side. A plastic plate is disposed within the wedge shaped cushion. Loops on the concave side of the wedge shaped cushion are used to secured the pads to the strap members. A smooth plastic membrane covers the wedge shaped cushion.

12 Claims, 3 Drawing Sheets

SHOULDER PAD ACCESSORY

BACKGROUND OF THE INVENTION

1. Field of the Invention

The present invention relates to padding devices, and in particular, to an accessory pad used in combination with a football or hockey shoulder pad.

2. Description of the Prior Art

Football players have all too often suffered shoulder and collar bone injuries due to lateral shoulder impacts. The impacts may result from a collision with the ground or another player. The injuries resulting from these impacts to the shoulder and collar bone typically occur because of the position of the shoulder in relation to the rest of the body of the player. The shoulders are the most lateral extension of the upper torso of the body and thus susceptible to lateral impact forces. The susceptibility to shoulder injuries is heightened in players having well developed shoulder muscles. In players having well developed shoulder muscles, their shoulders extend outward well beyond their hips and absorb the brunt of the lateral impact forces. Consequently, the players suffer injury because such a small area of the shoulder, in particular the deltoid region, is exposed to the extreme impact forces due to lateral collisions.

To protect the shoulders from injury, players of hockey, football, and other contact sports have generally worn shoulder pads. Shoulder pads are generally constructed of a hard outer shell of thermoformed plastic. Cushions are attached to the underside of the hard outer shells. The prior art shoulder pads typically provide effective protection from impacts to the top, front, and back portion of the shoulders and upper body. However, many prior art shoulder pads have failed to address the aforementioned problem.

U.S. Pat. No. 579,825, issued to Dora Harrison on Mar. 30, 1897; U.S. Pat. No. 2,369,229, issued to Josephine Hamlin on Feb. 13, 1945; and U.S. Pat. No. 2,808,589, issued to Else Tyroler on Oct. 8, 1957; all disclose garment shields or garment shields in combination with garment shoulder pads.

U.S. Pat. No. 2,320,705, issued to George C. Reynolds on Jun. 1, 1943, discloses a Kidney Guard for attachment to a waist or girdle which includes a fibre guard molded with an integral projecting ledge on the outer face of the guard. The projecting ledge is horizontally disposed to serve as a support for the belt portion of the trousers of a user.

U.S. Pat. No. 4,514,862, issued to Anthony A'Costa on May 7, 1985, discloses a Gun Recoil Protector which includes a main body portion and an arm protector. The main body portion fits over the shoulder and is held in place by suitable strap means. The arm protector is secured to the main body portion in the vicinity of the shoulder.

U.S. Pat. No. 4,573,216, issued to Walter Wortberg on Mar. 4, 1986, discloses an Impact Dissipator. The bell-shaped dissipator includes a shell-like outer layer made of an elastic rubber substance. Within the shell is a viscous fluid layer bonded to the outer shell.

U.S. Pat. No. 4,654,893, issued to Andrew Meyers et al. on Apr. 7, 1987, discloses a Shoulder Pad Brace which includes a pair of shock absorbing saddle assemblies and cups for protecting the acromioclavicular and glenohumeral joints of a user. Each saddle assembly includes a resilient, ring-shaped member for seating over and conforming to its respective acromioclavicular joint. The cups overlie each saddle assembly. Additionally, each cup includes anterior and posterior portions for protecting the front of the glenohumeral joint, and the back of the scapula respectively. Finally, each saddle assembly includes an upper arm pad which is attached to its respective saddle by means of an omni-directional hinge joint.

U.S. Pat. No. 4,985,931, issued to James C. Wingo on Jan. 22, 1991, discloses a Shock Absorbing Pad Structure for Athletic Equipment which includes a foam member having an undulated configuration formed by a plurality of elevations and depressions. The elevations and depressions are arranged in a staggered relationship with respect to one another. The foam member is disposed within a flexible, substantially air impermeable enclosure.

U.S. Pat. No. 5,060,313, issued to M. Neuhalfen on Oct. 29, 1991, discloses a Football Shoulder Pad With Outer Pads which includes a pair of relatively rigid arch portions which extend over the shoulders of a wearer and a pair of resilient pads which is removably secured to the front surfaces of the arch portions.

U.S. Pat. No. 5,063,941, issued to Christopher A. White on Nov. 12, 1991, discloses an Apparatus for Reducing the Occurrence of Shoulder Dislocation Subluxation During Athletic Activity which includes an athletic brace to be worn with conventional shoulder pads. The athletic brace includes a wide elastic member that is internally wrapped about the upper arm and brought across the chest for attachment to the front of the shoulder pads.

U.S. Pat. No. 5,107,542, issued to Robert M. Zide on Apr. 8, 1992, discloses a Front-Lock Stabilizer for Protective Shoulder Pads having breastplates and backplates. The breastplates of the shoulder pads are closed by laced interdigitated plates fixedly secured to the vertical edges of the breastplates. The backplates are closed by a plurality of rigid plates extending between and fixedly secured thereto.

U.S. Pat. No. 5,129,101, issued to Rogers Douglas on Jul. 14, 1992, discloses a shoulder pad which has auxiliary Impact Distributing Pads designed to conform to the shape of the wearer's shoulder. A hook-and-loop fastening strap is used to enable a series of wedge-like pads to be moved to various positions on the inside of the shoulder pad.

None of the above inventions and patents, taken either singly or in combination, is seen to describe the instant invention as claimed.

SUMMARY OF THE INVENTION

The shoulder pad of the present invention include a left body arch member and a right body arch member. A left chest portion and a left back portion depend from the left arch member. Two left strap members extends from the left back portion to the left chest portion. A right chest portion and a right back portion depend from the right arch member. Two right strap members extend from the right back portion to the right chest portion. The left and right strap members secure the shoulder pad to the body of the user. A left accessory pad and a right accessory pad are attached to the left and right strap members respectively. The accessory pads are disposed adjacent the armpits of the user between the user's arms and ribs.

Each accessory pad includes a wedge shaped cushion having a concave surface and opposing convex surface. A plastic plate within each wedge shaped cushion is disposed between the concave surface and convex surfaces. Loops on the concave surface are used to secure the pads to the strap members. A smooth plastic membrane covers the wedge shaped cushion to reduce friction and facilitate easy movement of the arms of the user. Each wedge shaped cushion also includes tapered edges to prevent the cushions from hindering the movement of the arms of the user.

One function of the pads is to increase the angle of the arms from the body. By increasing the angle, forces due to lateral collisions are absorbed by both the arm and the shoulder. The deltoid region of the shoulder is no longer the most lateral point of the shoulder nor the point to absorb the initial impact of a lateral blow. The area absorbing the impact is increased, with the impact forces spread from the lower humerus to the deltoid or joint region of the shoulder. By increasing the area to which the impact is applied, the pressure forces to the shoulder region are decreased. The cushions of the accessory pads also serve as an effective shock absorber to the lateral forces of impact. The plastic plate disposed within the wedge shaped cushion ensures that these lateral forces are distributed evenly throughout the pad.

The accessory pads of the present invention may be provided as part of an originally manufactured shoulder pad or flap jacket. The accessory pads could also be sold as an after market product.

Accordingly, it is a principal object of the invention to provide a shoulder pad which includes an accessory pad which increases the angle of the arms from the body.

It is another object of the invention to provide an accessory pad which absorbs lateral collision forces when worn between the arm and ribs of a user adjacent the armpit of the user.

It is a further object of the invention to provide an accessory pad which includes tapered edges to facilitate movement of a user's arm when the accessory pad is worn between the users arm and rib.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

Figure 1:
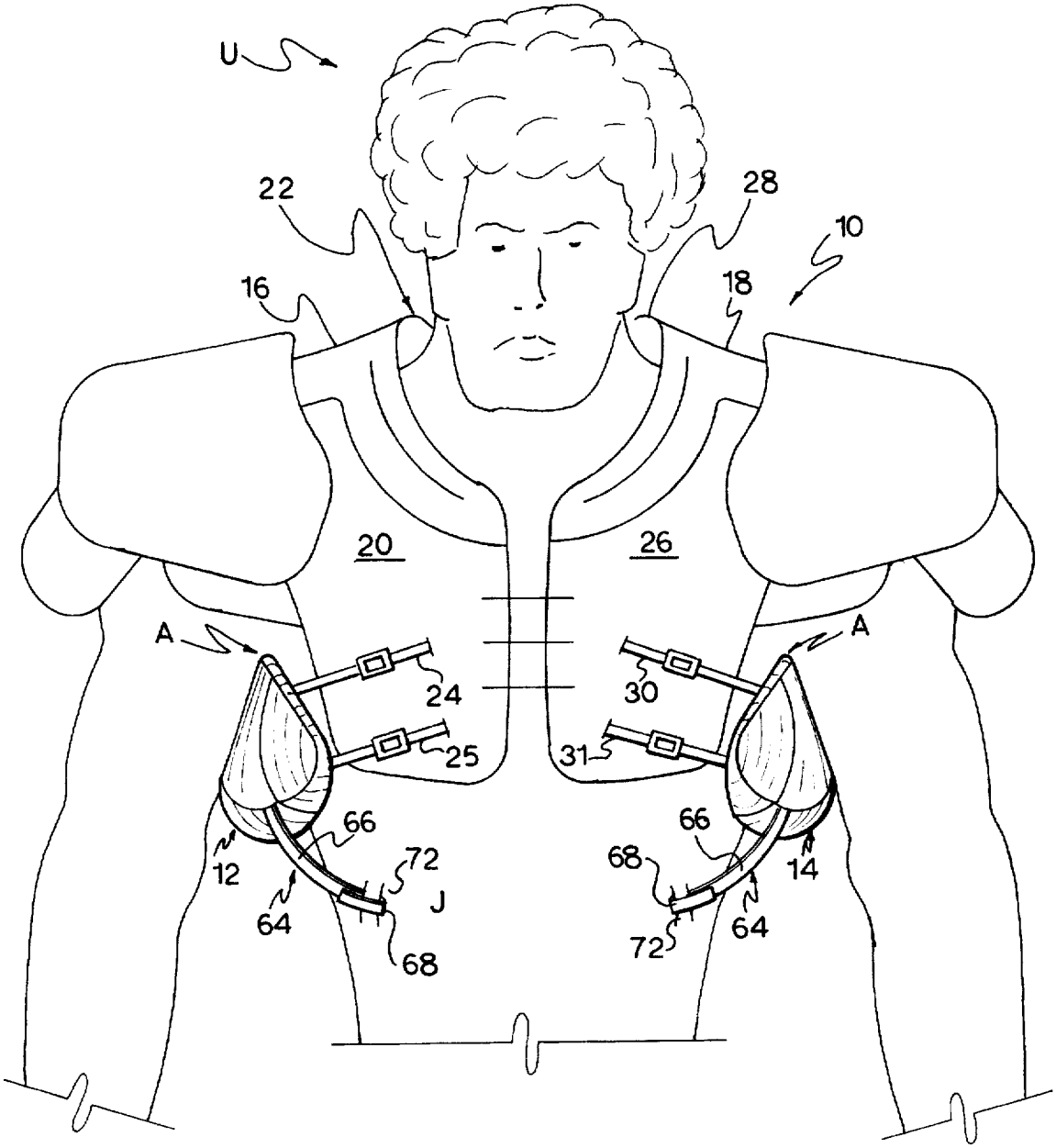
FIG. 1 is a front environmental view showing the shoulder pad of the present invention worn by a user, with the accessory pads of the invention secured to both the shoulder pad straps and a flack jacket worn by the user.
Figure 2:
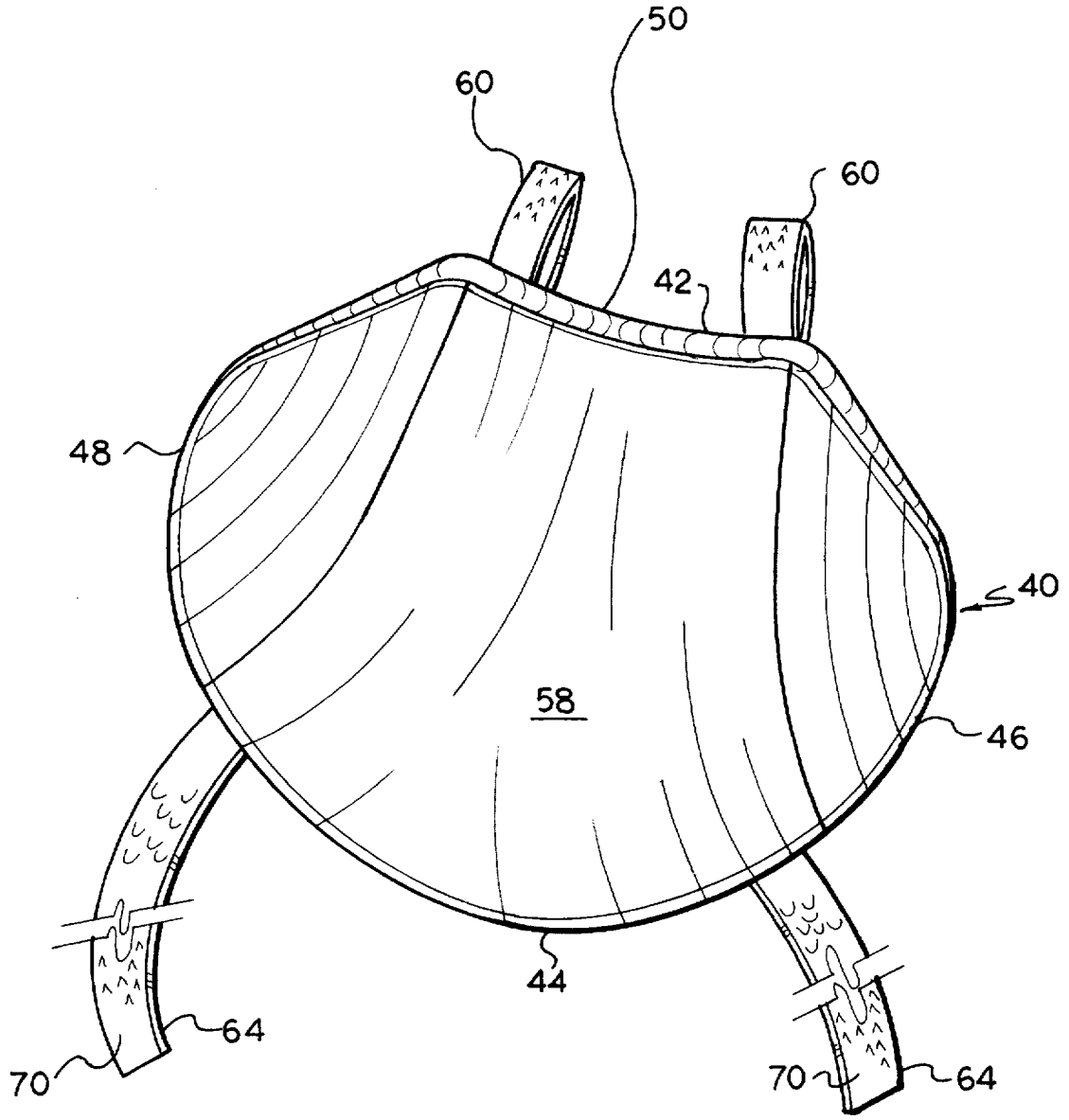
FIG. 2 is a front elevational view of the accessory pad of the present invention.
Figure 3:
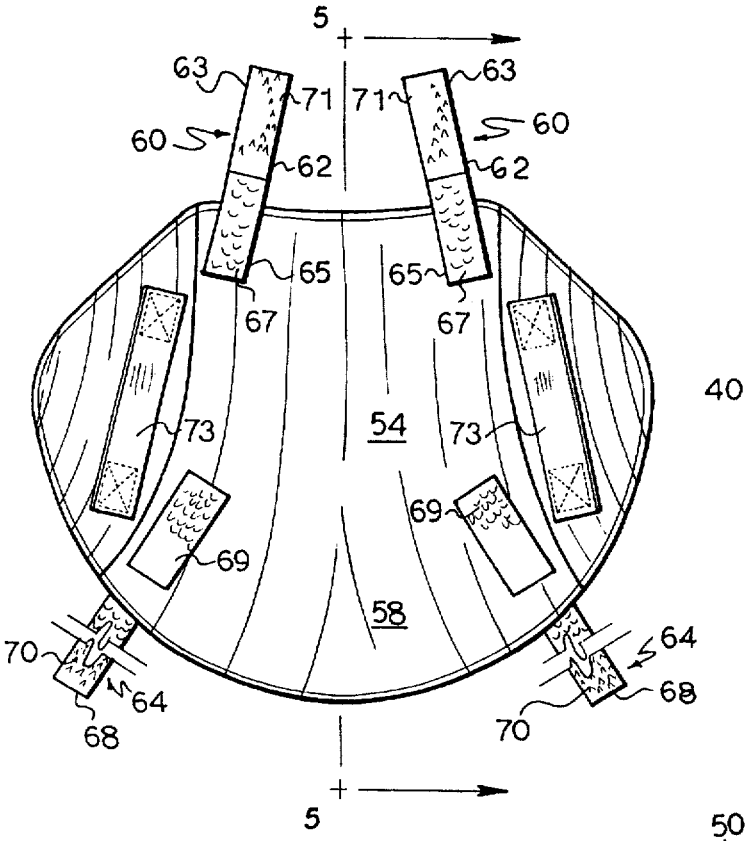
FIG. 3 is a rear elevational view of the accessory pad of the present invention.
Figure 4:
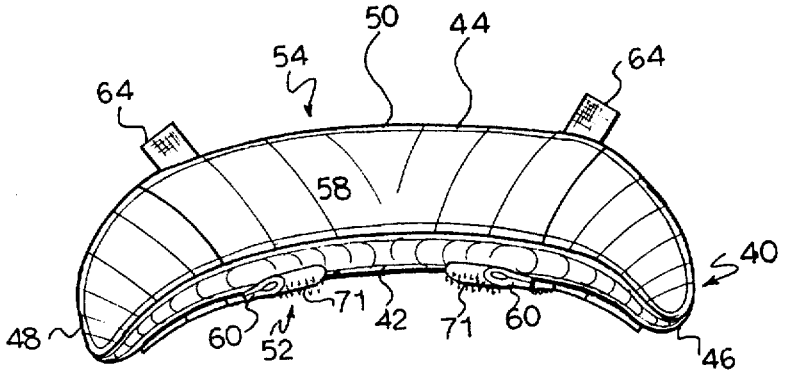
FIG. 4 is a top view of the accessory pad of the present invention.
Figure 5:
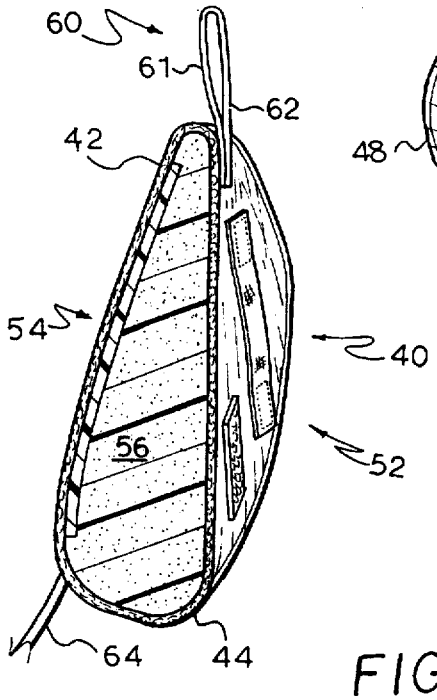
FIG. 5 is a left cross-sectional view of the accessory pad of the present invention taken along line 5—5 of FIG. 3.

FIG. 1 shows a shoulder pad 10 of the present invention which includes accessory pads 12,14 disposed adjacent to the armpit A of a user U. The shoulder pad 10 includes a left body arch member 16 and a right body arch member 18. A left chest portion 20 and a left back portion 22 depend from the left arch member 16. Two left strap members 24,25 extend from the left back portion 22 to the left chest portion 20. A right chest portion 26 and a right back portion as depend from the right arch member 18. Two right strap members 30,31 extend from the right back portion as to the right chest portion 26. The left and right strap members 24,25,30,31 secure the shoulder pad 10 to the body of the user U.

The left accessory pad 12 and the right accessory pad 14 are attached to the left strap members 24,25 and right strap member 30,31, respectively. As best shown in FIGS. 2–5, each accessory pad 12,14 includes a wedge shaped cushion 40 having a upper portion 42 and a lower portion 44. The upper portion 42 has a thickness less than that of the lower portion 44. The wedge shaped cushions 40 also have a concave side 52 and an opposing convex side 54 (see FIG. 4). The concave side 52 is dimensioned to conform to the ribs of the user. A rigid plate 56 is disposed below the surface of the convex side 54 (see FIG. 5) between the concave side 52 and the convex side 54. Each wedge shaped cushion 40 also includes a tapered first edge 46 and tapered second edge 48 joined by a middle portion 50 (see FIGS. 2 and 4). Each wedge shaped cushion 40 is tapered such that the tapered first edge 46 and the tapered second edge 48 are both thinner than the middle portion 50. A plastic membrane 58 covers the wedge shaped cushion 40. The tapered edges 46,48 allow free movement of the user's arms without interference from the wedge shaped cushion 40. The plastic membrane 58 also facilitates free movement by providing a smooth friction reducing surface.

Two loop members 60 are attached to the concave side 52 of each wedge shaped cushion 40. The loop members 60 extend upwardly beyond the upper portion 42 of the wedge shaped cushion 40. Each loop member includes a first face 61 and opposing second face 62 (see FIG. 5). The first face 61 is attached to the concave side 52. An upper portion 63 of the second face 62 includes a portion of hook and loop fabric 71. A lower portion 65 of the second face 62 includes a mating portion of hook and loop fabric 67. The position of a loop 60 may be adjusted by securing a portion of the upper portion 71 to the lower portion 67. The upper straps 24,30 are threaded through the loop members 60 before securement to the shoulder pad 10. Two additional loop members 73 are secured to the concave side 52 of each wedge shaped cushion 40. The lower strap members 25,31 are threaded through the loop members 73 before securement to the shoulder pad 10.

Each wedge shaped cushion 40 also includes a pair of securing straps 64. Each strap 64 has one end 66 (FIG. 1) attached to a lower portion of the convex side of the wedge shaped cushion 40. A second free end 68 of each strap 64 includes portions of hook and loop fabric 70. As shown in FIG. 1, each securing strap 64 is threaded through slots 72 in a flak jacket J worn by the user U and secured to the flak jacket using the hook and loop fabric portion 70 of the second free end 68 of each strap 64. The securing straps 64 are pulled tautly through the slots 72 to draw the accessory pads 12,14 snug to the body of the user U. The securing straps 64 may also be used in conjunction with other equipment or garments (not shown) worn by the player to secure the accessory pads 12,14 against the body of the user U.

When the strap 64 are not used with a flack jacket, the free end 68 of the strap may be secured by attaching the hook and loop fabric 70 of the straps to a mating portion of hook and loop fabric 69 attached to the concave side 52 of each wedge shaped cushion 40.

The accessory pads 12,14 may also be secured against the body of the user independent of the shoulder pad 10 by incorporating the pads 12,14 into a flack jacket J or other equipment worn by the user.

The shoulder pads 10 are generally constructed of hard plastic or a similar material well known in the art. The accessory pads 12,14 are also composed of materials well known in the art. The wedge shaped cushion 40 of each accessory pad is composed of a shock absorbing foam such as those known in the art. The material should be firm enough to resist deformations due to slight pressures, but yield and deform to absorb lateral impact forces. The rigid plate 56 may be constructed from a sheet of plastic or similar material. The plastic membrane 58 may consist of a coating sprayed onto the wedge shaped cushion. The plastic membrane could also consist of a shrink-wrap material applied to the wedge shaped cushion. In any case, the plastic membrane 58 would have a smooth surface to facilitate movement of the arms of an user against the accessory pads. The size and thickness of the accessory pads may be varied to suit the individual player. Configuration of the wedge cushion may also vary to create the optimum angle between the arms and sides of a user.

It is to be understood that the present invention is not limited to the sole embodiment described above, but encompasses any and all embodiments within the scope of the following claims.

What is claimed is:

1. A shoulder pad for impact sports comprising:

a left body arch member including a left chest portion and a left back portion, said left chest portion and said left back portion depending from said left body arch member;

a left strap member extending from said left back portion to said left chest portion;

a left accessory pad attached to said left strap member, wherein said left accessory pad includes a left cushion having first side and a second side, a rigid plate disposed within said left cushion between said first side and said second side, and a plastic membrane covering said left cushion;

a right body arch member including a right chest portion and a right back portion, said right chest portion and said right back portion depending from said right body arch member;

a right strap member extending from said right back portion to said right chest portion; and a right accessory pad attached to said right strap member, wherein said right accessory pad includes a right cushion having a first side and a second side, a rigid plate disposed within said right cushion between said first side and said second side of said right cushion, and a plastic membrane covering said right cushion.

2. The shoulder pad according to claim 1, wherein said left accessory pad is removably attached to said left strap member and said right accessory pad is removably attached to said right strap member.

3. The shoulder pad according to claim 1, including a left loop member attached to said left accessory pad, said left loop member disposed around said left strap member to secure said left accessory pad to said left strap member, and a right loop member attached to said right accessory pad, said right loop member disposed around said right strap member to secure said right accessory pad to said right strap member.

4. The shoulder pad according to claim 1, including a left securing strap having one end attached to said left accessory pad and a second free end, and a right securing strap having one end attached to said right accessory pad and a second free end.

5. The shoulder pad according to claim 1, wherein said left accessory pad includes a left wedge shaped cushion having an upper portion and a lower portion, with said upper portion having a thickness less than that of said lower portion, and said right accessory pad includes a right wedge shaped cushion having an upper portion and a lower portion, with said upper portion of said right wedge shaped cushion having a thickness less than that of said lower portion of said right wedge shaped cushion.

6. The shoulder pad according to claim 5, wherein said left wedge shaped cushion has a concave side, an opposing convex side, a rigid plate disposed between said concave side and said convex side of said left wedge shaped cushion, and a plastic membrane covering said left wedge shaped cushion, and said right wedge shaped cushion has a concave side, an opposing convex side, a rigid plate disposed between said concave side and said convex side of said right wedge shaped cushion, and a plastic membrane covering said right wedge shaped cushion.

7. The shoulder pad according to claim 6, wherein said left wedge shaped cushion includes a first loop member attached to said concave side of said left wedge shaped cushion, with said first loop member removably disposed around said left strap member, and said right wedge shaped cushion includes a second loop member attached to said concave side of said right wedge shaped cushion, with said second loop member removably disposed around said right strap member.

8. The shoulder pad according to claim 7, wherein said left wedge shaped cushion includes a tapered first edge and a tapered second edge joined by a middle portion, said middle portion having a thickness greater than that of said tapered first edge and said tapered second edge, and said right wedge shaped cushion includes a tapered first edge and a tapered second edge joined by a middle portion, said middle portion of said right wedge shaped cushion having a thickness greater than that of said tapered first edge and said tapered second edge of said right wedge shaped cushion.

9. The shoulder pad according to claim 8, including a first securing strap having a first end and a second end, said first end attached to a lower portion of said convex side of said left wedge shaped cushion, and a second securing strap having a first end and a second end, said first end of said second securing strap attached to a lower portion of said convex side of said right wedge shaped cushion.

10. A shoulder pad for impact sports comprising:

a left body arch member including a left chest portion and a left back portion, said left chest portion and said left back portion depending from said left arch member;

a left strap member extending from said left back portion to said left chest portion;

a right body arch member including a right chest portion and a right back portion, said right chest portion and said right back portion depending from said right body arch member;

a right strap member extending from said right back portion to said right chest portion;

a left accessory pad including a left wedge shaped cushion having an upper portion and a lower portion, said upper portion having a thickness less than that of said lower portion, said left wedge shaped cushion having a concave side, an opposing convex side, a rigid plate disposed between said concave side and said convex side of said left wedge shaped cushion, and a plastic membrane covering said left wedge shaped cushion, said concave side and said convex side joined by a tapered first edge and a tapered second edge, said tapered first edge and said tapered second edge joined by a middle portion, and said middle portion having a thickness greater than that of said tapered first edge and said tapered second edge;

a third securing strap having one end attached to a lower portion of said convex side of said right wedge shaped cushion am a second free end; and a fourth securing strap having one end attached to a lower portion of said convex side of said left wedge shaped cushion an a second free end.

11. An accessory pad for preventing injury to the shoulder of a user, said accessory pad disposed on the side of the user adjacent the arm pit, said accessory pad comprising:

a wedge shaped cushion having a upper portion and a lower portion, said upper portion having a thickness less than that of said lower portion;

said wedge shaped cushion also having a concave side, and an opposing convex side, said concave side and said convex side of said wedge shaped cushion joined by a tapered first edge and a tapered second edge, said tapered first edge and said tapered second edge joined by a middle portion, and said middle portion having a thickness greater than that of said tapered first edge and said tapered second edge;

a loop member adapted to receive a shoulder pad strap, said loop member attached to said concave side of said wedge shaped cushion and extending upwardly beyond said upper portion of said wedge shaped cushion;

a rigid plate disposed between said concave side and said convex side of said wedge shaped cushion; and a plastic membrane covering said wedge shaped cushion.

12. The accessory pad according to claim 11, wherein said loop member includes a first face and an opposing second face, said first face attached to said concave side of said wedge shaped cushion, said opposing second face includes a portion of hook and loop fabric attached to an upper portion of said second face and a mating portion of hook and loop fabric attached to a lower portion of said second face.

* * * * *